US005792969A

United States Patent [19]

Shubb et al.

[11] Patent Number: 5,792,969

[45] Date of Patent: Aug. 11, 1998

[54] CAPO

[76] Inventors: Richard Shubb, 20560 Heron Dr., Bodega Bay, Calif. 94923; David Coontz, Rte. 3, Corydon, Iowa 50060

[21] Appl. No.: 845,811

[22] Filed: Apr. 29, 1997

[51] Int. Cl.[6] ..... G10D 3/00

[52] U.S. Cl. ..... 84/318

[58] Field of Search ..... 84/318, 315, 316, 84/317

[56] References Cited

U.S. PATENT DOCUMENTS

| | | | |
|---|---|---|---|
| 4,149,443 | 4/1979 | Bringe | 84/318 |
| 4,250,790 | 2/1981 | Shubb et al. | 84/318 |

*Primary Examiner*—Michael L. Gellner
*Assistant Examiner*—Shih-yung Hsieh
*Attorney, Agent, or Firm*—Sean M. Brennan; Morrison & Foerster LLP

[57] ABSTRACT

An improved capo for use with various stringed instruments is provided. The capo comprises a frame having a top arm to contact the strings and a side arm, with a jaw member and a lever member both pivotally attached to the side arm. The jaw member contacts the back of the instrument neck when the capo is closed. Mounted on the lever member is a flexible member, having a follower surface that contacts the lower surface of the jaw member during the closing action of the capo and while the capo is closed. An adjustable stop passes through the lever member such that one end of the adjustable stop contacts the lower surface of the flexible member to urge the follower surface into contact with the lower surface of the jaw member. The improved capo of the invention is easier to attach and remove than capos of the prior art, maintains better alignment between the jaw member and the lever member, is less subject to frictional wear, and optimizes the degree of dropoff along the entire useable range of the capo.

20 Claims, 3 Drawing Sheets

JAW MEMBER:

FIG 4 LEVER MEMBER: bottom view with adj. stop
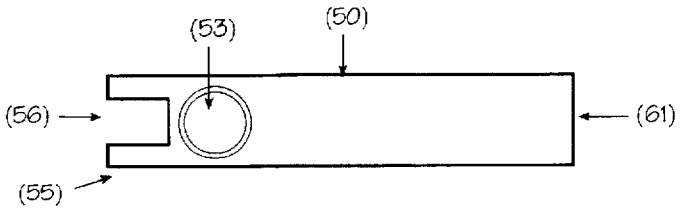
FIG 5 bottom view without adj. stop
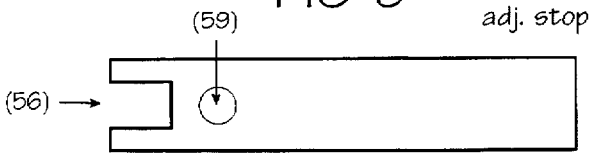
FIG 6 side view
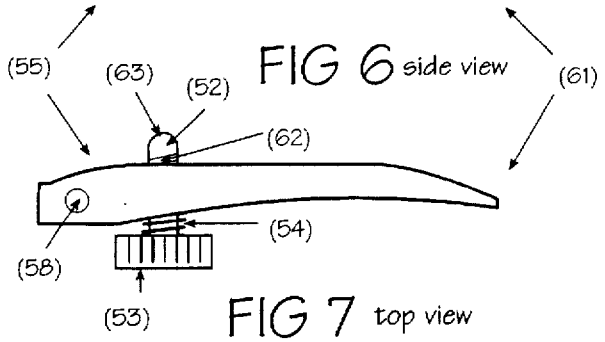
FIG 7 top view
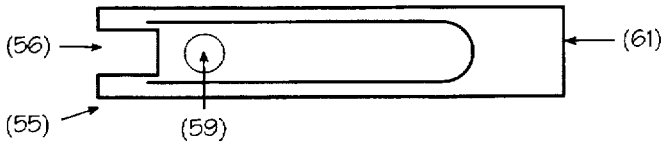
FIG 8
FLEXIBLE MEMBER:
top view
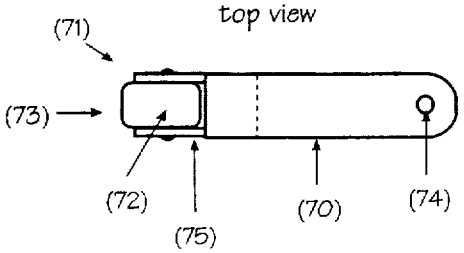
FIG 9
LEVER MEMBER and FLEXIBLE MEMBER, side view cutaway:
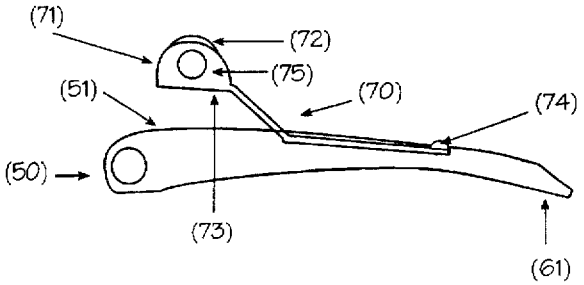

CAPO

FIELD OF INVENTION

The invention relates to a capo for raising the pitch of a stringed musical instrument having a neck and a fingerboard, with the strings disposed across the fingerboard.

BACKGROUND

A capodastro, or capo as it is commonly known, is a device that is attached to the neck of a stringed instrument to shorten the effective length of the strings by depressing them against the fingerboard, thereby raising their pitch. As a result, a limited number of chord formations can be used to play in a variety of different keys.

U.S. Pat. No. 4,250,790 describes an adjustable, positive locking capo comprising a frame having a top arm that bears against the strings and a side arm extending laterally of the instrument neck. Pivotally attached to the side arm are a jaw member extending under the back of the instrument neck and a lever member located below the jaw member. An adjusting screw extends through the lever member to bear against the lower surface of the jaw member when the lever member is pivoted toward the jaw member. As the lever member is pivoted toward the jaw member, the tip of the adjusting screw encounters a zone of interference with the lower surface of the jaw member. As the lever member continues to be pivoted toward its upwardmost position, the screw passes through the zone of interference, effecting a positive looking action, whereby the upper surface of the jaw member engages the back of the instrument neck and the top arm depresses the strings against the fingerboard on the top of the neck. The adjusting screw may be advanced or backed off to vary the extent to which the jaw member closes, thereby allowing the capo to accommodate varying sizes of instrument neck, and allowing the user to regulate the pressure exerted by the capo on the instrument strings. In this prior art capo, friction between the tip of the adjusting screw and the lower surface of the jaw member led to the development of considerable wear on these parts, often leading to loss of alignment, and would sometimes contribute to difficulty in closing the capo. Furthermore, the disposition of the adjusting screw relative to the jaw member led to differential "dropoff" across the operating range of the capo.

DISCLOSURE OF THE INVENTION

The object of the present invention is to provide an improved capo that has a smoother locking and releasing action, that prolongs the useful life of the capo by reducing wear due to friction and maintaining alignment between the jaw member and lever member, and that optimizes the "dropoff" phenomenon that is characteristic of this type of capo.

Accordingly, the present inventors have devised improvements to the capo described in U.S. Pat. No. 4,250,790 which provide additional advantages over those associated with the capo of the prior art. It has been found that optimal performance of the capo requires that a parallel alignment be maintained between the lever member and the jaw member. However, prolonged use of the capo of the prior art often resulted in loss of alignment, leading to poor fit, which can result in string buzz and other undesirable effects. In the use of the capo of the prior art, it was also found that considerable resistance is encountered as the tip of the adjusting screw passes through its zone of interference with the lower surface of the jaw member, which can result in excessive wear on the capo, as well as posing an inconvenience to the user in attaching the capo to and/or removing the capo from the neck of the instrument. In addition, the capo of the prior art is prone to variabilities in dropoff (a phenomenon to be described below) at the extremities of its range.

The present invention comprises an improved capo for a stringed instrument such as a guitar or banjo, said instrument having a neck with upper and lower surfaces. The upper surface of the neck comprises a fingerboard which also may contain raised frets attached to the neck and disposed perpendicular to the longitudinal axis of the neck. The improved capo of the invention comprises a frame, said frame comprising a top arm and a side arm. The top arm extends over the strings and presses the strings against the fingerboard when the capo is in its closed position. The side arm is integrally connected to the top arm and extends laterally of the neck of the instrument. Pivotally attached to the side arm is a jaw member which is capable of extending below the neck of the instrument. The lower surface of the jaw member is contoured so as to form a sliding pair with a follower surface of a flexible member, as described below.

A lever member is pivotally attached to the side arm at a position lower (i.e., further from the back of the neck) than the jaw member. Attached to the upper surface of the lever member is a flexible member having a follower surface. The contoured lower surface of the jaw member and the follower surface form a sliding pair, thereby maintaining a parallel alignment between the lever member and the jaw member as the capo is closed into its locked position. An adjustable stop passes through the lever member such that one of the ends of the adjustable stop bears on the lower side of the follower surface of the flexible member.

The improved capo of the invention can be attached and removed smoothly and easily and is adjustable to accommodate instrument necks of varying sizes. In addition, the improvements of this invention result is less lateral displacement of the lever member and the jaw member with respect to each other, leading to a longer useable lifetime for the capo. Furthermore, prior capos of this type exhibited variabilities in the degree of a phenomenon called "dropoff", at the extreme high and low ends of their adjustable range. The improved design of the present invention minimizes variability in the beneficial dropoff phenomenon, providing optimal dropoff regardless of the thickness of the instrument neck.

BRIEF DESCRIPTION OF THE DRAWINGS

For purposes of illustration, and to more clearly set out the novel features of the claimed invention, the following drawings are provided.

FIG. 4 shows a bottom view of the lever member, with the adjustable stop.

FIG. 5 shows a bottom view of the lever member, with the adjustable stop omitted.

FIG. 6 shows a side view of the lever member, including the adjustable stop but with the flexible member omitted.

FIG. 7 shows a top view of the lever member, with the adjustable stop and the flexible member omitted.

FIG. 8 shows a top view of the flexible member.

FIG. 9 shows a cutaway side view of the flexible member attached to the lever member, with the adjustable stop omitted.

DETAILED DESCRIPTION

Figure 1:
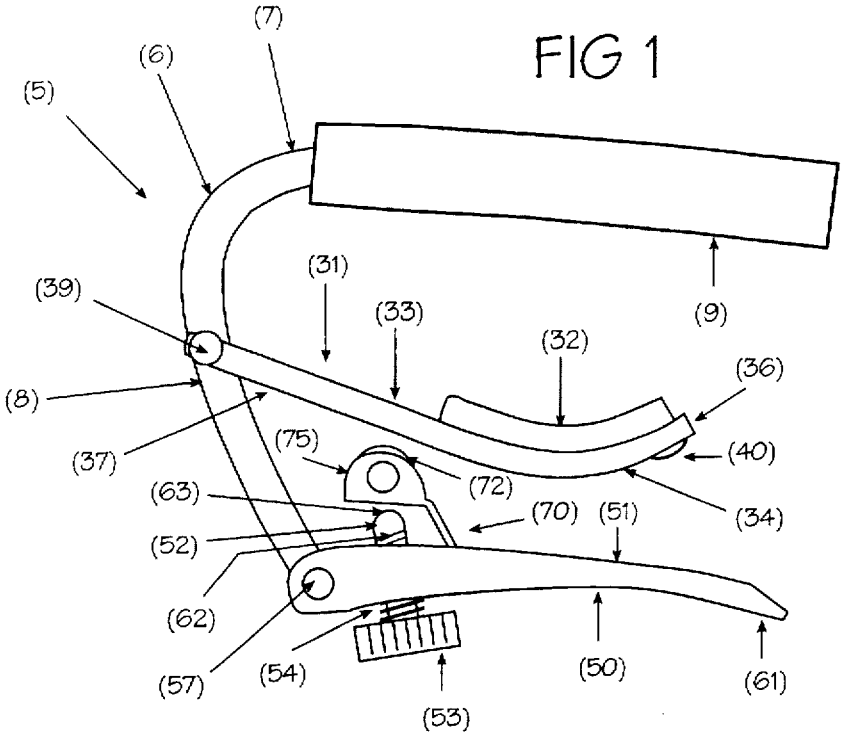
FIG. 1 shows a side elevation of the capo of the invention.
Figure 2:
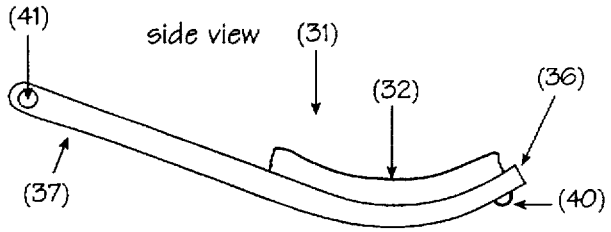
FIG. 2 shows a side elevation of the jaw member.

Referring to the drawings, the main elements of the improved capo 5 of the invention are a frame 6, a jaw member 31, a lever member 50, a flexible member 70 ending in a follower surface 71, and an adjustable stop 52.

The frame 6 comprises a top arm 7 and a side arm 8. The top arm 7 extends over the fingerboard 21 of the instrument and contains a pad 9 on its lower surface which contacts the strings 22 when the capo is in its closed position. The side arm 8 is attached to the top arm 7 and extends distally downward from the top arm 7 lateral to the neck 20 of the instrument.

Figure 3:
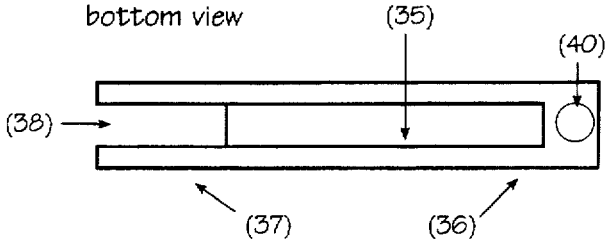
FIG. 3 shows a bottom view of the jaw member.

A jaw member 31 is pivotally attached to the side arm 8 at a position on the side arm between the free end and the end that is connected to the top arm, such that the distal portion 36 of the jaw member 31 is able to contact the back of the neck 20. In a preferred embodiment, the jaw member 31 is connected to the side arm 8 by having a slot 38 in the proximal end 37 of the jaw member which receives the side arm. A roll pin 39 is inserted through bores 41 in the lugs formed in the proximal end 37 of the jaw member 31 and a bore through side arm 8 to provide a pivotal connection. The jaw member is curved to generally match the curvature of the back of the neck 20 of the instrument. A pad of soft, non-marking material 32 may be attached to the upper surface 33 of the jaw member 31 to prevent damage to the back of the neck 20 when the capo is in the closed position. Preferably, the lower surface 34 of the jaw member 31 is configured so as to guide the motion of a follower member. More preferably, the lower surface 34 of the jaw member 31 contains a channel 35, more easily viewed in FIG. 3, to engage a follower member to be described below. Optionally, a small bumper 40 of resilient material may be present on the lower surface 34 of the distal end 36 of the jaw member 31, where it contacts the upper surface 51 of the lever member 50 when the capo is in the closed position. This will prevent any vibration or buzzing which might result from metal-to-metal contact when the capo is in the closed position, and avoid unnecessary noise during closing of the capo.

A lever member 50 is pivotally attached to the side arm 8 of the frame at a location below (i.e., in the direction away from the back of the neck) the point of attachment of the jaw member 31. This connection is made in a similar fashion to that between the jaw member 31 and the side arm 8. The proximal end 55 of the lever member 50 forms a slot 56 which receives the side arm 8. A roll pin 57 is inserted through bores 58 in the lugs formed in the proximal end 55 of the lever member 50 and a bore through side arm 8 to provide a pivotal connection.

The lever member 50 additionally contains a threaded bore 59, located between the proximal end 55 and the center of the lever member 50. The threaded bore 59 receives an adjustable stop 52, to be described below. Optionally, a small bumper made of resilient material may be present on the upper surface 51 of the distal end 61 of the lever member 50, where it contacts the lower surface 34 of the jaw member 31 when the capo is in the closed position. This will prevent any vibration or buzzing which might result from metal-to-metal contact when the capo is in the closed position, and avoid unnecessary noise during closing of the capo.

A flexible member 70 is mounted on the upper surface 51 of the lever member 50 in such a way that one end of the flexible member is attached close to the distal end 61 of the upper surface 51 of the lever member 50 (as seen most clearly in FIG. 9). Attachment is by means of a rivet 74 or equivalent fastener. The end of the flexible member not attached to the lever member (hereby defined as the distal end 73 of the flexible member) comprises a follower surface 71 which will interact with the lower surface of the jaw member as the capo is closed. The follower surface 71 may be configured to match a particular configuration on the lower surface 34 of the jaw member, so that the follower surface 71 is guided in a path along the lower surface 34 of the jaw member. In a preferred embodiment, the lower surface 34 of the jaw member will have a channel 35, in which the follower surface 71 will ride as the capo is opened and closed. In a particularly preferred embodiment, the follower surface 71 will comprise a cylindrical roller 72 mounted in a roller housing 75 on the distal end 73 of the flexible member. The dimensions of the roller 72 will be such that the roller fits inside the channel 35 on the lower surface 34 of the jaw member 31. During closing of the capo, and when the capo is locked in its closed position, the follower surface 71 will contact the lower surface 34 of the jaw member 31.

The improved capo of the invention is adjustable, allowing it to be used with a variety of neck sizes, and permitting regulation of tension by the user. The capo is adjusted by means of an adjustable stop 52 passing through the proximal end 55 of the lever member 50. The upper end 63 of the adjustable stop bears against the lower surface of the distal end 73 of the flexible member 70. In a preferred embodiment, the adjustable stop 52 is a threaded screw or bolt, having a head 53 and a threaded shaft 62 passing through a threaded bore 59 in the lever member. The threaded screw or bolt will preferably possess, on its lower end, a knurled head 53 by which the screw or bolt may be easily adjusted by the user. In a particularly preferred embodiment, a spring 54 is disposed about the threaded shaft 62 of the screw or bolt between the head 53 and the lower surface of the lever member 50. This serves to prevent axial movement of the screw or bolt when the capo is disengaged, thereby maintaining the set position of the shaft 62 within the bore 59 and, hence, the level of tension selected by the user.

In use, the improved capo of the invention is brought adjacent to the fingerboard 21 of the instrument so that the top arm 7 is in contact with the strings 22 from above, the side arm 8 extends laterally of the neck 20 and downward, and the jaw member 31 lies underneath but not touching the back of the neck 20. In this position, the jaw member 31 and the lever member 50 are able to pivot freely. To close the capo, in a preferred embodiment, the lever member 50 is moved toward the jaw member 31, thereby causing the cylindrical roller 72 at the distal end 73 of the flexible member 70 to contact the lower surface 34 of the jaw member 31. Once this contact is established, further motion of the lever member 50 toward the jaw member 31 causes the cylindrical roller 72 to travel in the channel 35 along the lower surface 34 of the jaw member 31, resulting in the movement of the jaw member 31 toward and eventually into contact with the back of the neck 20. As the jaw member 31 makes contact with the back of the neck 20, further upward movement of the lever member 50 will increase the pressure of pad 9, attached to top arm 7, against the strings 22, pressing them against the fingerboard 21.

Figure 10:
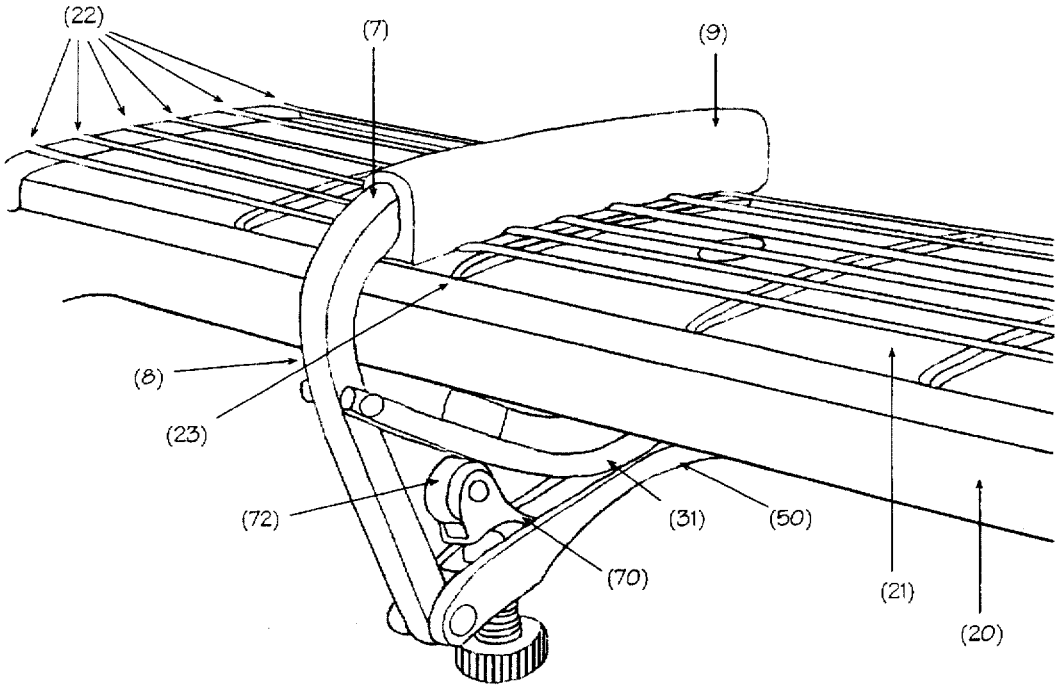
FIG. 10 shows the capo of the invention attached to the neck of a stringed instrument.

Continued upward movement of the lever member 50 toward the jaw member 31 will cause the cylindrical roller 72, in its transit through the channel 35 along the lower surface 34 of the jaw member 31, to pass through a central zone of interference and beyond. Movement beyond this zone of interference results in a rapid locking action, whereby the distal end 61 of the lever member 50 comes into contact with the distal end 36 of the jaw member 31, and the cylindrical roller 72 at the distal end 73 of the flexible member 70 remains in contact with the channel 35 along the lower surface 34 of the jaw member 31 at the proximal end 37 of the jaw member-31. Locking of the capo brings the pad 9 attached to the top arm 7 into contact with the strings in much the same way as a finger forming a barre chord. Thus, when the capo is in its locked position, the strings 22 are depressed by pad 9 sufficiently to make contact with a fret 23. The capo of the invention, in its locked position attached to the neck of a guitar, for purposes of example, is shown in FIG. 10.

A positive locking action is involved in the closing of the capo, because the follower surface 71 passes through a central zone of interference in its transit along the lower surface 34 of the jaw member 31. The follower surface 71 is able to pass through this zone and continue along the lower surface 34 of the jaw member 31, because of the flexibility of the flexible member 70 on which it is mounted and because the pad 9 attached to the top arm 7 and the pad 32 attached to the upper surface 33 of the jaw member 31 both can be slightly resilient. Thus, during the closing action, the pads 9 and 32 are able to distort slightly as the jaw member 31 undergoes a condition of maximum compression which occurs at the zone of interference, then relaxes slightly as the capo is moved into the fully closed position. This phenomenon, wherein the capo is not at its maximum state of compression when fully closed, is known as "dropoff." That is, the tension exerted by the capo on the neck 20 of the instrument "drops off" as the capo is brought from an intermediate position of maximum tension into the fully closed position. The implications of this dropoff phenomenon and the beneficial effects on dropoff provided by the capo of the present invention will be discussed below.

The adjustable stop 52 is advanced or withdrawn, while the capo is disengaged, so that when the capo is locked, the top arm 7 exerts sufficient pressure on the strings 22 to prevent them from buzzing on the frets, but not so much pressure as to damage the neck 20 of the instrument or bend the strings across the fret to such an extent that the strings become sharp. One of skill in the art will realize that a capo is used to raise the pitch of the strings in precise increments, which are defined by the difference in pitch between notes produced by strings fretted at adjacent frets. Excessive pressure of strings against a fret, such as may be caused by overtightening of a capo, could result in bending of the string on the side of the fret facing the capo, leading to an increase in pitch exceeding that due to the increment between frets, i.e. the strings would become sharp.

In addition, tightening or loosening of the adjustable stop 52 will permit the use of the capo with different-sized necks.

When in the closed position and attached to the neck 20 of an instrument, the capo can be opened by moving the distal end 61 of the lever member 50 downward and away from the jaw member 31. In a preferred embodiment, the distal end 61 of the lever member 50 extends beyond the distal end 36 of the jaw member 31, to make opening the capo more convenient.

The improved capo of the invention provides several advantages over capos of the prior art. In its preferred embodiment, wherein a roller 72 mounted in a housing 75 located on the distal end 73 of the flexible member 70 follows a channel 35 on the lower surface 34 of the jaw member 31, a smooth opening and closing action is obtained which reduces wear, makes it easy for the user to attach and remove the capo, and minimizes the chance of damage to the instrument or the capo. In previous capos, this interaction is often highly frictional, contributing to increased wear and making opening and closing of the capo more difficult.

Another advantage of the preferred embodiment roller-channel combination of the present invention is that it maintains a parallel alignment between the lever member 50 and the jaw member 31 as the capo is used over time. In capos of the prior art that lack such a guide mechanism, an initially parallel alignment of the lever member and jaw member is often lost over time, leading to poorer performance.

A further advantage of the improved capo of the present invention is that it minimizes the variability of "dropoff" across the useable range of the capo. Dropoff describes a particular effect in the closing action of the improved capo of the invention and certain capos of the prior art, e.g., U.S. Pat. No. 4,250,790; referring to the difference in the amount of pressure applied to the strings and fingerboard at two different positions in the closing action of the capo. In certain capos of the prior art, such as that described in U.S. Pat. No. 4,250,790, an adjusting screw is threaded through a lever member, and the tip of this adjusting screw contacts the lower surface of a jaw member during the closing action of the capo and when the capo is in the closed position. In adjusting this prior art capo to fit necks of different sizes, this adjusting screw is tightened or loosened. In the act of being tightened or loosened, the adjusting screw travels through the lever member in a straight line perpendicular to the longitudinal axis of the lever member. As the capo is closed, the tip of the adjusting screw, in its transit along the lower surface of the jaw member, passes through a center point of maximum resistance. This is also the point at which maximum pressure is exerted on the strings by the capo. As the tip of the adjusting screw continues past the center point during the closing action, less resistance is encountered, and the jaw member incrementally falls away from the back of the neck or "drops off." Consequently, maximum pressure is not exerted at the closed position of the capo.

This property of dropoff can have certain advantageous effects in preventing the user from inadvertently overtightening the capo, thereby driving the strings out of tune. However, in the capo of the prior art, dropoff is variable along the range of adjustment of the capo. This results from the fact that, as the adjusting screw is tightened, the final point of contact between the tip of the adjusting screw and the lower surface of the jaw member (at the closed position of the capo) moves further from the center point of maximum resistance, thereby increasing the degree of dropoff. Thus, dropoff is maximized at the narrowest end of the capo's range where the adjusting screw is furthest advanced (i. e., for thinner necks) and minimized at the widest end of the range at which the adjusting screw is minimally advanced (i.e., for thicker necks). One consequence is, that on an instrument with a very thin neck (i.e., at the narrow end of the capo's range), a high degree of dropoff might lead to insufficient pressure on the strings, causing them to buzz against the frets. Conversely, on wide-necked instruments, a lower degree of dropoff is achieved, resulting in overtightening of the capo, and leading to the possibility of a less secure lock with the concurrent risk of unexpected release of the capo.

The design of the improved capo of the present invention results in decreased variability in the degree of dropoff across the fill range of the capo. This is accomplished by the inclusion of a flexible member 70, which is attached to the upper surface 51 of the lever member 50 and whose distal end 73 contacts the lower surface 34 of the jaw member 31 as the capo is closed and locked. The flexible member 70 is adjusted by advancing or retracting an adjustable stop 52 whose upper end 63 bears against the lower surface of the flexible member 70. In contrast to capos of the prior art in which the point of contact with the jaw member (i.e., the tip of the adjusting screw) travels in a straight line as the screw is tightened, the follower surface 71 of the flexible member 70 travels in an arc as the adjustable stop 52 is advanced. Consequently, the follower surface 71 of the flexible member 70 will be closer to the center point, when the capo is closed, at all stages of adjustment (i.e., at all degrees of advancement or retraction of the adjustable stop 52), maintaining an optimum degree of dropoff along the entire range of the capo.

Obvious modifications to the improved capo of the present invention, such as alteration of the size to accommodate larger or smaller necks, changing the shape of the jaw member or top arm to accommodate instruments with different curvature of the back or fingerboard, or modifications of the configuration of the lower surface of the jaw member in concert with the follower end, along with other modifications that are obvious to those skilled in the art of stringed instrument manufacture and accessories, are contemplated by the present invention, which is limited only by the scope of the appended claims.

We claim:

1. A capo for use with a stringed instrument having a plurality of strings and a neck, said neck comprising a fingerboard and a back, said capo comprising:

a frame comprising a top arm that extends across the fingerboard above the strings and a side arm that extends generally laterally of the neck;

a jaw member extending under said back, said jaw member having proximal and distal ends, the proximal end of which is pivotally attached to the side arm, said jaw member also having upper and lower surfaces, said upper surface capable of contacting said back;

a lever member having proximal and distal ends, the proximal end of which is pivotally attached to the side arm at a point below the site of attachment of the jaw member to the side arm, said lever member having upper and lower surfaces, said lever member having attached to its upper surface a flexible member having upper and lower surfaces, said flexible member also having proximal and distal ends wherein the distal end of the flexible member comprises a follower surface that is capable of contacting the lower surface of the jaw member; and an adjustable stop passing through said lever member, said adjustable stop having a first end and a second end, said second end of which bears against the lower surface of the flexible member.

2. The capo of claim 1, wherein said follower surface is contoured.

3. The capo of claim 1, wherein the lower surface of the jaw member possesses a contoured surface.

4. The capo of claim 1, wherein the lower surface of the jaw member possesses a contoured surface and the follower surface is contoured.

5. The capo of claim 4, wherein the contour of the follower surface is fitted to the contoured surface of the jaw member.

6. The capo of claim 5, wherein the lower surface of the jaw member comprises a channel.

7. The capo of claim 6, wherein the follower surface comprises a roller mounted in a roller housing.

8. The capo of claim 1, wherein the follower surface comprises a roller mounted in a roller housing.

9. The capo of claim 1, wherein said lever member comprises a threaded bore, and said adjustable stop is an adjusting screw, passing through said lever member and having a threaded shaft that is received by said threaded bore.

10. The capo of claim 9, wherein the first end of said screw has a head for gripping and turning the screw to advance or withdraw the screw within the bore.

11. The capo of claim 10, further comprising a helical spring disposed about said threaded shaft between the head of the screw and the lower surface of the lever member.

12. The capo of claim 1, wherein the flexible member is a flat spring.

13. The capo of claim 1, wherein said top arm further comprises a resilient material that contacts the strings.

14. The capo of claim 1, wherein said jaw member further comprises, on its upper surface, a soft material capable of contacting the back of the neck without damaging said back.

15. The capo of claim 1, wherein the jaw member inclines downwardly relative to the top arm and is curved to facilitate snug engagement with the back of the neck when the capo is closed about the neck.

16. The capo of claim 15, wherein the distal end of the lever member extends beyond the distal end of the jaw member when the capo is closed about the neck.

17. The capo of claim 1, wherein a piece of resilient material is present on the distal end of the lower surface of the jaw member, said piece of resilient material capable of contacting the upper surface of said lever member.

18. The capo of claim 1, wherein a piece of resilient material is present on the distal end of the upper surface of the lever member, said piece of resilient material capable of contacting the lower surface of said jaw member.

19. A capo for use with a stringed instrument having a plurality of strings and a neck, said neck comprising a fingerboard and a back, said capo comprising:

a frame comprising a top arm with upper and lower surfaces, said top arm extending across the fingerboard above the strings and containing a resilient pad on its lower surface, and a side arm that extends generally laterally of the neck;

a jaw member having proximal and distal ends, the proximal end of which is pivotally attached to the side arm, said jaw member extending under said neck and being inclined downwardly relative to the top arm, said jaw member being curved to facilitate snug engagement with said back, said jaw member also having an upper surface and a lower surface, said upper surface including a soft pad for contacting the back of the neck, said lower surface including a channel and optionally including a piece of resilient material on the lower surface of its distal end;

a lever member having proximal and distal ends, the proximal end of which is pivotally attached to the side arm at a point below the site of attachment of the jaw member to the side arm, and the distal end of which extends beyond the distal end of the jaw member when the capo is closed about the neck, said lever member possessing a threaded bore, said lever member also having upper and lower surfaces and optionally including a piece of resilient material on the upper surface of its distal end;

a flexible member attached to the upper surface of the lever member, said flexible member having upper and lower surfaces, said flexible member having a cylindrical roller mounted in a roller housing attached to its upper surface such that said roller is capable of movably engaging the channel on the lower surface of the jaw member;

an adjusting screw, passing through said lever member and having a threaded shaft that is received by said threaded bore of said lever member, one end of said screw comprising a head for gripping and turning the screw to advance or withdraw the screw within the bore and the other end of said screw bearing against the lower surface of the flexible member; and a helical spring disposed about said threaded shaft between the head of the screw and the lower surface of the lever member, for maintaining the position of the screw within the bore.

20. In a capo for use with a stringed instrument comprising a frame, a jaw member with upper and lower surfaces, a lever member with upper and lower surfaces and an adjusting screw with a first end and a second end; the improvement wherein:

said jaw member possesses a contoured lower surface;

said lever member further comprises a flexible member attached to its upper surface, said flexible member including a roller mounted in a roller housing on its distal end, said roller capable of movably engaging the contoured lower surface of the jaw member; and the second end of said adjusting screw bears on the lower surface of said flexible member.

* * * * *